US005863335A

United States Patent [19]

Wilber, Jr.

[11] Patent Number: 5,863,335

[45] Date of Patent: Jan. 26, 1999

[54] WALL PROTECTOR

[76] Inventor: Willis Edwin Wilber, Jr., 6 Wilber La., Saugerties, N.Y. 12477

[21] Appl. No.: 909,207

[22] Filed: Aug. 11, 1997

[51] Int. Cl.[6] ..... B05C 21/00

[52] U.S. Cl. ..... 118/504; 428/904.4; 428/192; 402/80 P

[58] Field of Search ..... 118/504, 213, 118/301, 407; 428/904.4, 192; 434/81, 430, 269; 402/80 P

[56] References Cited

U.S. PATENT DOCUMENTS 4,090,464 5/1978 Bishopp et al. ..... 116/63 R
5,010,671 4/1991 Stonehouse ..... 40/594
5,201,954 4/1993 Holt ..... 118/309

FOREIGN PATENT DOCUMENTS 0334360 9/1989 European Pat. Off. ..... 118/504

*Primary Examiner*—Laura Edwards

[57] ABSTRACT

A wall protector with a multiplicity of sheets of protective material bound together between a pair of interlocking members that are held together by pegs formed on one member and that are press fitted into openings in the other member. Openings in the members provide one means by which the wall protector can be held in place on a wall. The pegs pass through the multiplicity of sheets and when a sheet is soiled it can be torn off the pegs and the next sheet then protects the wall from soil.

6 Claims, 1 Drawing Sheet

WALL PROTECTOR

BACKGROUND OF THE INVENTION

1. Field of the Invention

This invention relates to wall protectors and more particularly to wall protectors that have a multiplicity of sheets which may be readily torn off one at a time when soiled.

2. Description of the Prior Art and Objects of the Invention

It is a recognized problem to have places where soil quickly occurs on a surface. Walls in back of kitchen sinks and basins are one well known place where soil quickly builds up on a wall. Both inside and outside, garbage cans are also a source of soil building up on an adjoining vertical surface or wall.

Protective removable sheets have been used to provide a fresh clean surface free of soil by peeling off the soiled outer surface. The Holt, U.S. Pat. No. 5,201,954 teaches a series of layers to provide a clean spray booth by having plurality of removable wall covering units. Each unit generally covers a rectangular portion and has a series of sheet, one over the other, which adhere to one another but may be peeled from one another. Thus any unit which becomes soiled can have the outer sheet removed leaving the next lower clean sheet exposed.

The Bishopp et. al., U.S. Pat. No. 4,090,464, teaches the use of a plastic or vinyl material covering the face off a road sign so that in the event vandals deface the sign, the covering may be peeled off and replaced by a fresh sheet leaving a clean sign.

The Stonehouse, U.S. Pat. No. 5,010,671 teaches a flip-chart of a series of sheets which may be written on and removed and placed on a wall where they sheets are individually held in place by static cling. Stonehouse does not consider the issue of protecting a wall from soil but rather a display device as would be used in lectures.

None of the above Patents provides a Wall Protector with a multiplicity of sheets which can be readily placed on a wall where soil is prone to occur and where once soiled, the exposed sheet can be removed leaving a clean surface.

Accordingly, it is an object of the present invention to provide a Wall Protector that can be mounted in virtually any location to provide a multiplicity of sheets that can be easily removed one at a time.

Accordingly, it is a further object of the present invention to provide a Wall Protector where a soiled sheet can be easily removed and disposed of readily.

Accordingly, it is a further object of the present invention to provide a Wall Protector that is attractive.

Accordingly, it is another object of the present invention to provide a Wall Protector that is economical.

Other objects and advantages of the present invention will become apparent to those of ordinary skill in the art as the description thereof proceeds.

SUMMARY OF THE INVENTION

A Wall Protector is provided having a multiplicity of separate sheets of moisture resistant durable material bound together at the top edge of all the sheets by means of two bands with pegs mounted on one band press fitted into the other band, the sheets having holes through them through which the pegs fit and which permits the sheets to be easily torn off the pegs while the remaining sheets remain in place. Apertures through the band provide a means to secure the Wall Protector to a wall.

DESCRIPTION OF THE DRAWINGS

The invention may be readily understood by referring to the accompanying drawings, in which.

DESCRIPTION OF A PREFERRED EMBODIMENT

Figure 1:
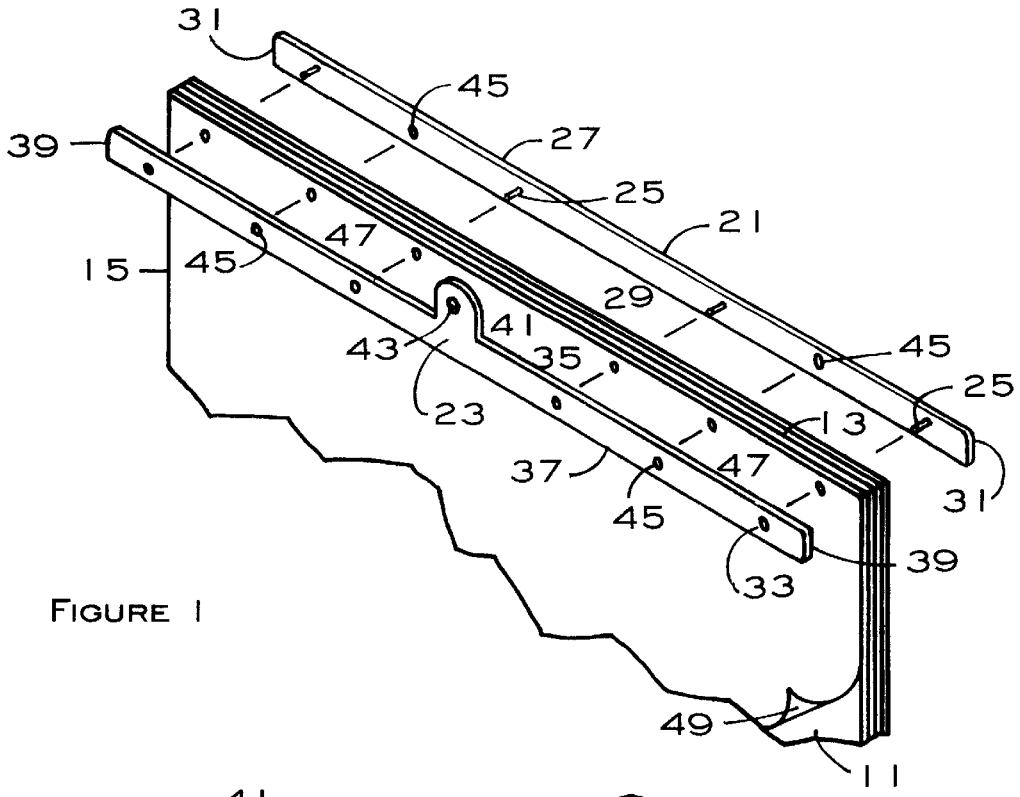
FIG. 1 is a pictorial view of the top portion of a multiplicity of sheets and an exploded view of the bands showing the pegs on the front band and holes in the rear band.
Figure 2:
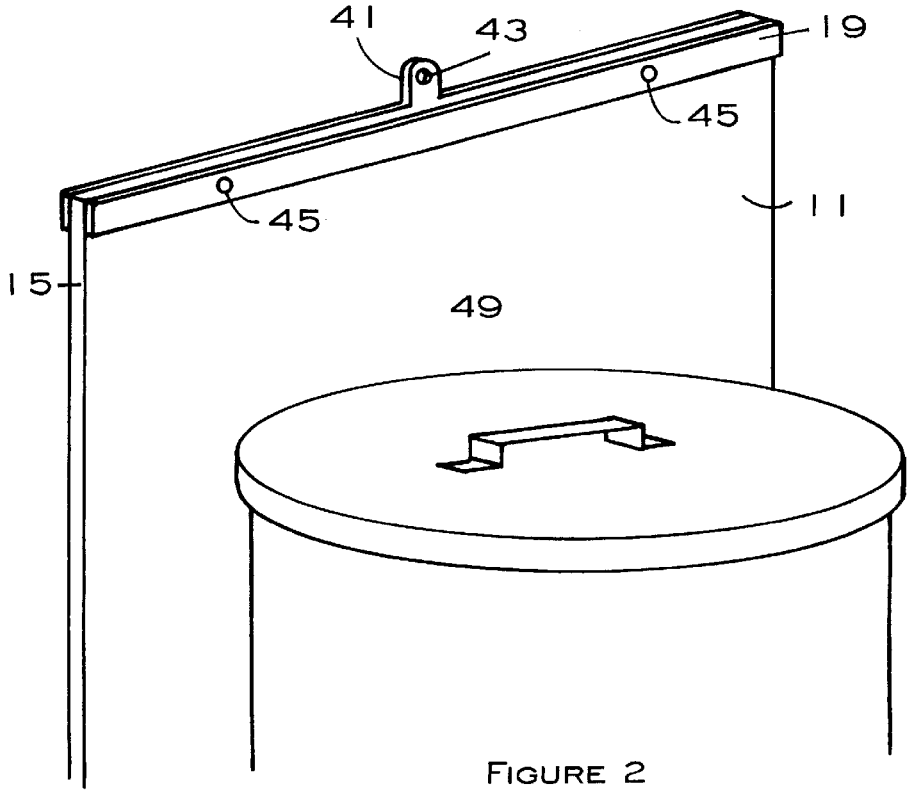
FIG. 2 is a pictorial view of the Wall Protector in a vertical position as placed on a wall with a garbage pail in front of it.

The Wall Protector, in accordance with this invention, as best seen in FIG. 1 includes a plurality of sheets 11. Each sheet 11 has a top edge 13 and two ends 15 and a bottom edge (not shown). Each sheet 11 must be made from a durable material and be moisture resistant. Co-extruded polypropylene sheets 11 having a thickness of approximately one one thousandths of an inch, and which are generally clear, provide an excellent sheet 11. The number of sheets 11 can vary from only a few to several dozen and the size of the sheets 11 can vary depending upon the application. For example, a Wall Protector for use behind a sink would be smaller than a Wall Protector for use outside by a large outdoor garbage receptacle.

The sheets 11 are held together and suspended by two bands 19, namely a front band 21 and a rear band 23. The front band 21 has a series of pegs 25, usually four, mounted on the front band 21. The pegs 25 each have a circular cross section. The front band 21 has a top edge 27 and a bottom edge 29 and two ends 31. Each peg 25 is located midway between the top edge 27 and the bottom edge 29. The pegs 25 are symmetrically located on the front band 21. The rear band 23 has a series of openings 33, usually four, which are aligned with the pegs 25 of the front band 21. The openings 33 in the rear band 23 are symmetrically located on the rear band 23. The rear band 23 also has a top edge 35 and a bottom edge 37 and two ends 39. The openings 33, which have a circular cross section, in the rear band 23 are also generally located midway between the top edge 35 and the bottom edge 37. The rear band 23 and the front band 21 have substantially the same dimensions and configuration. The rear band 23, however, has a loop 41 centrally located on the top edge 35 between the two ends 39. The loop 41 has a hole 43 through it and serves as one means to hang the Wall Protector on a wall. The front band 21 and the rear band 23 each have apertures 45 generally located equidistant from the ends 39 and midway between the top edges 27,35 and the bottom edges 29,37. The apertures 45 in the front band 21 and the rear band 23 are aligned with one another and provide two more places where the Wall Protector can be secured by such fixtures as hangers, nails or screws to a wall. The apertures 45 are symmetrically located on both the rear band 23 and the front band 21. The Wall Protector can also be mounted by other means, such as hook and loop tape (not shown).

The openings 33 in the rear band 23 are slightly smaller in diameter than the diameter of the pegs 25 mounted on the front band 21. As a result, the pegs 25 on the front band 21 are press fitted into the openings 33 in the rear band 23 and thus the front band 21 and rear band 23 are locked to one another with the sheets 11 secured between them. The sheets 11 also have openings 47 aligned with the pegs 25 on the front band 21 and the openings 33 in the rear band 23. The pegs 25 are located through the openings 47 in the sheets 11. The openings 47 in the sheets 11 are close to the top edge 13 of the sheets 11. The sheet 11 furthest from the wall and the rear band 23 and closest to the front band 21 is the exposed sheet 49 which is the sheet 11 subject to being soiled. If the exposed sheet 49 becomes soiled, it can be easily pulled out by merely tearing the material of the sheet 11 between the openings 47 and the top edge 13 of the sheet 11 being removed. The remaining sheets 11 remain secured in place and are held in place by the pegs 25 in the openings 47 in the sheets 11 despite the removal of the exposed sheet 49 after it becomes soiled.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

I claim:

1. A Wall Protector for mounting on a wall to protect the wall and provide a multiplicity of clean surfaces, said Wall Protector comprising:

a multiplicity of separate sheets made from co-extruded polypropylene and having a thickness of approximately one one thousandths of an inch, each sheet having a top edge and having four openings and two apertures located adjacent the top edge of the multiplicity of sheets;

a front band having a top edge and a bottom edge and two ends and having four pegs located generally midway between the top edge and the bottom edge and spaced symmetrically between the two ends, the pegs having a circular cross section; and a rear band having a top edge and a bottom edge and two ends and having four openings and two apertures located generally midway between the top edge and the bottom edge and spaced symmetrically between the two ends, the openings having a circular cross section, the rear band and the front band having substantially the same configuration and dimensions, the openings having a circular cross section slightly less than the circular cross section of the pegs, the rear band having a loop mounted on the top edge generally midway between the ends of the rear band for mounting the rear band, the loop having a hole through it, the openings in the rear band and the openings in the multiplicity of sheets being aligned with one another and with the pegs in the front band, the pegs being located in the openings in the multiplicity of sheets and being force fitted into the openings in the rear band, the apertures in the front band and the rear band and in the multiplicity of sheets being aligned with one another.

2. A Wall Protector for mounting on a wall to protect the wall and provide a multiplicity of clean surfaces, said Wall Protector comprising:

a multiplicity of separate sheets made from a durable moisture resistant material, each sheet having a top edge and having a plurality of openings located adjacent the top edge of the multiplicity of sheets;

a front band having a top edge and a bottom edge and two ends and having a plurality of pegs located generally midway between the top edge and the bottom edge and spaced symmetrically between the two ends, the pegs having a circular cross section;

a rear band having a top edge and a bottom edge and two ends and having a plurality of openings located generally midway between the top edge and the bottom edge and spaced symmetrically between the two ends, the openings having a circular cross section, the rear band and the front band having substantially the same configuration and dimensions, the openings having a circular cross section slightly less than the circular cross section of the pegs, the openings in the rear band and the openings in the multiplicity of sheets being aligned with one another and with the pegs in the front band, the pegs being located in the openings in the multiplicity of sheets and being force fitted into the openings in the rear band; and means for mounting disposed on the rear band.

3. A Wall Protector according to claim 2 wherein the durable moisture resistant material is co-extended polypropylene.

4. A Wall Protector according to claim 2 wherein the durable moisture resistant material is co-extended polypropylene having a thickness of approximately one one thousandths of an inch.

5. A Wall Protector according to claim 2 wherein the plurality of openings and pegs is four openings and four pegs.

6. A Wall Protector according to claim 2 wherein the means for mounting the Wall Protector includes a loop mounted on the top edge of the rear band, the loop being located midway between the ends of the rear band.

* * * * *